US005896821A

United States Patent [19]

Neely et al.

[11] Patent Number: 5,896,821

[45] **Date of Patent: * Apr. 27, 1999**

[54] TUFTING MACHINE GAUGING ELEMENT CONFIGURATION

[75] Inventors: Marshall Allen Neely, Soddy Daisy, Tenn.; Wilton Hall, Oglethorpe, Ga.

[73] Assignee: Card-Monroe Corp., Chattanooga, Tenn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/897,982

[22] Filed: Jul. 18, 1997

[51] Int. Cl.[6] ..... D05C 15/22

[52] U.S. Cl. ..... 112/80.52

[58] Field of Search ..... 112/80.5, 80.4, 112/80.45, 80.52, 80.6, 80.53

[56] References Cited

U.S. PATENT DOCUMENTS

| | | | |
|---|---|---|---|
| 3,202,379 | 8/1965 | Dedmon et al. | 112/80.52 |
| 3,919,953 | 11/1975 | Card et al. | 112/80.52 X |
| 4,303,024 | 12/1981 | Bardsley | 112/80.52 |
| 4,366,761 | 1/1983 | Card | 112/79 A |
| 4,440,102 | 4/1984 | Card et al. | 112/266.2 |
| 4,448,137 | 5/1984 | Curtis et al. | 112/80.5 X |
| 4,619,212 | 10/1986 | Card et al. | 112/266.2 |
| 4,630,558 | 12/1986 | Card et al. | 112/266.2 |
| 4,815,403 | 3/1989 | Card et al. | 112/80.51 |
| 4,836,118 | 6/1989 | Card et al. | 112/80.41 |
| 4,903,624 | 2/1990 | Card et al. | 112/410 |
| 4,903,625 | 2/1990 | Card et al. | 112/410 |
| 5,058,518 | 10/1991 | Card et al. | 112/266.2 |
| 5,224,434 | 7/1993 | Card et al. | 112/80.41 |
| 5,295,450 | 3/1994 | Neely | 112/80.45 |
| 5,400,727 | 3/1995 | Neely | 112/80.45 |
| 5,513,586 | 5/1996 | Neely et al. | 112/80.01 |

*Primary Examiner*—Ismael Izaguirre
*Attorney, Agent, or Firm*—Womble Carlyle Sandridge & Rice, PLLC

[57] ABSTRACT

A conventional tufting machine is provided with front and rear juxtaposed, laterally shiftable, needle bars positioned on a common needle bar support. A first series of needles having a first take-off hand, in a first gauge, are embedded in a first needle gauge block mounted on the front needle bar. A second series of needles of an opposite take-off hand, in a second gauge, are embedded in a second needle gauge block fastened to the rear needle bar. The needles of the first and second series of needles, respectively, combine together to form a third series of needles of a desired gauge of the machine, the gauge of the machine being narrower than the gauge of either the first or second series of needles, respectively. A looper gauge block is positioned with respect to the needle gauge blocks, the looper gauge block having a first and a second series of spaced and parallel loopers embedded therein, each looper of the second series of loopers being paired with an adjacent one of the loopers of the first series of loopers to form spaced pairs of loopers extending along the length of the looper gauge block. The loopers within each pair of loopers have a take-off hand corresponding to that of the needle the looper will engage, and the take-off hands within each pair of loopers are opposed to one another. The loopers within each pair of loopers are spaced apart a first distance, and each of the pairs of loopers are spaced apart from one another a second distance greater than the first distance.

24 Claims, 6 Drawing Sheets

TUFTING MACHINE GAUGING ELEMENT CONFIGURATION

FIELD OF THE INVENTION

This invention relates in general to tufting machines and to gauging elements used with tufting machines. More particularly, this invention relates to an improved tufting machine needle and looper configuration for use with loop pile tufting machines.

BACKGROUND OF THE INVENTION

The use of tufting machines to create tufted articles, for example tufted carpet, is well known in the art. Conventional tufting machines use a reciprocating needle bar carrying a plurality of aligned needles thereon, the needles being arranged into a row, or rows of needles carried on the needle bar, the needles being constructed and arranged to reciprocally penetrate a backing material passing transversely underneath the needle bar and passing over an adjustable bed plate. The bed plate may be adjusted with respect to the needles for increasing or decreasing the height of the tufted piles so created. As the needles penetrate the backing material, they carry a filament of yarn therethrough, whereupon the yarn is caught either by a looper positioned with respect to the needle to create a looped pile of yarn, or by a hook moving in timed relationship with a knife to create a cut pile of yarn. It is by these well known processes, for example, that loop pile and cut pile tufted carpeting is made.

Early tufting machines typically used a single row of aligned and spaced needles mounted on a single needle bar, in conjunction with either a single looper or a hook/knife combination for each such needle, to create either a loop pile or cut pile tufted article. As known to those of skill in the art, the needles used in tufting machines have a take-off hand which is formed by a target and an adjacent yarn pickup area defined on one side of the needle. It is against the target and the yarn pickup area that the bill of a looper, or hook, will slidingly pass, above the eye of the needle, to catch the yarn in the throat of the looper or hook, respectively, such that when the needles are withdrawn backward through the backing material on a backstitch, a loop of yarn, a tuft, is retained with respect to the backing material. The looper or hook which engages the appropriate target and/or pickup area, will have a corresponding take-off hand. Therefore, if the needle has a right take-off hand, the looper will be provided with a bias point having a right take-off hand such that the left leading edge of the looper will strike the target area on the right side of the needle and slide up over the target area and onto the pickup area to hook or loop the tuft of yarn prior to the needle moving upward and back through the backing material on the backstitch.

In a large majority of tufting machines, all of the needles will have a common take-off hand as will the loopers. Due to the fact that the loopers engage, i.e. strike, the take-off areas of their respective needles, the loopers will tend to deflect in that direction so that a right hand take-off looper striking a right hand take-off needle will tend to be deflected to the right of the needle due to the mechanical interaction of the looper as it goes through a rocking motion with respect to the needle at its bottom dead center position.

Also, and as well known, tufted articles may be produced in a range of gauges, the gauge being equal to a number of gauging elements, for example, needles, loopers, hooks/knives, or even reeds, extending along a predetermined gauging length, the gauging length being a predetermined unit of length, for example divisions of an inch, extending across a portion of the width of the tufted article being produced. An eighth gauge machine, therefore, would have eight gauging elements, for example, needles, extending along the width of a single gauge distance, i.e. eight needles per inch.

Tufting machines having a gauge of one tenth of an inch or less are considered to be "close" or "narrow" gauge machines, in that the gauging elements are, of necessity, fit closely with respect to one another within the predetermined gauge distance. For example, and in contrast to an eighth gauge machine, a sixteenth gauge machine will have sixteen gauging elements, twice the number of gauging elements of an eighth gauge machine, extending along the same predetermined gauge length of a gauging block or bar, for example. This results in a very close spacing of the gauging elements with respect to one another, and oftentimes requires that these gauging elements be made much smaller than are larger gauge needles and loopers, or hooks/knives, so that the requisite spacing exists between gauging elements to allow the loopers and yarns to freely pass between the needles during tufting. However, in close gauge machines, not only are the gauging elements themselves constructed to be finer, but the yarns themselves must also be finer, i.e., of smaller diameter, all of which costs more money to manufacture due to the more exacting tolerances and relatively minute size of each of these gauging elements, and yarns, respectively. Smaller diameter yarns also tend to be more fragile, and thus are more prone to being accidentally cut.

On the other hand, an eighth gauge machine provides twice the spacing of a sixteenth gauge machine within the same gauge distance, thus allowing for the use of larger needles which are easier to manufacture and which cost less to make, and the use of larger yarns, which also cost less to manufacture, as well as the use of larger loopers and/or hooks/knives, which are also easier to manufacture and also cost less. Another advantage of larger gauge machines is that a lower number of stitches are required per unit length of the tufted article in order to provide an adequate face weight of the tufted article, whereas a close gauge machine requires a greater number of stitches in order to provide the same weight of yarn along the same unit length of the tufted article. For example, in order to achieve a desired weight, an eighth gauge machine may only require six stitches per inch, whereas a sixteenth gauge machine may require somewhere in the range of from twelve to fourteen stitches per inch to provide the same face weight of the finished tufted article.

Moreover, during the tufting process, as the yarns are passed by the needles through the backing material, in conjunction with whether the respective yarns are being fed to the needles by either a front or a rear yarn feed device, the yarns tend to take on a yarn twist such that the penetration of the needles and yarns through the backing material, and the withdrawal of the needles backward through the backing material on the backstitch as the yarn is held in position by a hook or loop, tends to impart a discernible twist to the yarns in the face of the tufted article. Accordingly, when right hand take-off needles and loopers are used, the yarns will have a tendency to twist in a common direction. This is not a significant problem in large gauge tufting machines as the yarns are relatively large, and tend to bloom up to fill the space between the adjacent rows of the yarns such that a uniform finished surface appearance of the tufted article is provided. However, when close gauge machines are used, the use of finer yarns results in the likelihood that a gap between rows of tufted material may be present due to the yarn twist.

As tufting machines have evolved, the use of dual needle bar machines, in which each needle bar laterally shifts with respect to the other, known as a "graphics" type of tufting machine, has developed. An example of such a machine is disclosed in U.S. Pat. No. 4,366,761 to Card, issued Jan. 4, 1983. These tufting machines use a needle for shifting device for each needle bar to shift the needle bars, with respect to one another, for example in opposite directions, or in timed relationship with respect to one another to form a graphic pattern or design in the face of the tufted article. An example of a needle shift device used with this kind of machine is disclosed in U.S. Pat. No. 4,440,102, to Card et al., issued Apr. 3, 1984.

In these dual needle bar machines, a first series of gauging elements, for example a first, front row of needles, will be mounted on the first needle bar, each of the gauging elements having a first gauge, for example, an eighth gauge spacing of the needles. The second needle bar will be provided with a second, rear series of needles, which may be of the same, or a differing gauge with respect to the first series of needles. Both series of needles, however, may be of the same take-off hand, such that if each needle had a right take-off hand, the yarns tufted by each row of needles will tend to lean to the right with the result that the yarns that are taken off from the front row of needles will lean to the right, whereas the yarns taken off of the rear row of needles will tend to lean to the left if a right hand take-off needle is used on both the front and rear series of needles. In larger gauge machines, for example anything greater than tenth gauge, this problem is minimized due to the size of the yarns. However, with close gauge machines, this use of the same hand tufting gauge elements on both the front and rear needle bars tends to accentuate the yarn twists such that any gap between the yarns may become more apparent.

Also, even though a pair of shifting needle bars may be used, a close gauge dual shifting needle bar machine still requires more stitches per inch in order to achieve the same face weight of the tufted article as does a dual needle bar machine having larger gauge needles using larger diameter yarns. Additionally, when using finer yarns in close gauge machines, these yarns tend not only to be more expensive to produce, but also are more likely to break or cut if pinched during the tufting process, and will not bloom after tufting to the extent a larger diameter yarn will.

One approach to obtaining a higher quality tufted article on dual shifting needle for machines has been to use gauging elements of an opposite hand on each respective needle bar, so that, for example, the front needle bar will have needles of a right take-off hand, and the rear needle bar will have needles of a left take-off hand. When the tufting operation is being performed, therefore, the yarns of the first and second series of needles will tend to lean in the same direction, thus minimizing the problems of gaps between adjacent rows of tufts due to yarn twist. Again, this problem is less pronounced when using larger diameter yarns than it is when using smaller diameter yarns. Another approach which is known in the art is to use a "semi-modular" looper block assembly in a non-casted arrangement having two series of loopers which are manually mounted and aligned, and with each series having opposite takeoffs with respect to one another. This looper assembly comprised a rectangular steel block with slots for individual loopers to be manually inserted, with detents holding the loopers in place. A square channel was broached through the semi-modular block, which itself was mounted to a staff that was located into a looper guide bar. These loopers were designed to cooperate with needles of opposite takeoffs. This arrangement, however, nevertheless relied upon a configuration including loopers held in place by detents, which necessarily included the inherent problems of a non-casted module.

It has also been known in the use of tufting machines to position and set each gauging element separately within the appropriate gauge bar, and to hold the elements in position with set screws or the like. Due to the difficulty inherent in positioning each respective needle or looper by hand within the appropriate gauge bar, for example a needle bar or a looper gauge bar, however, and then securing the gauging element with a set screw, the use of cast gauging modules or blocks has been developed in which a cast modular gauge block is produced having a sufficient number of gauging elements, be they needles or loopers, embedded therein. These modular gauge blocks offer the advantages of uniform and consistent gauging element spacing, and are easier to remove and replace than are the gauging elements themselves, when done separately in accordance with past practice. An example of this type of gauging module is disclosed in U.S. Pat. Nos. 5,295,450, and 5,400,727, issued to Neely on Mar. 22, 1994, and Mar. 28, 1995, respectively.

One problem that arises with the use of close or narrow gauge gauging elements on a dual shifting needle bar machine, where all of the gauging elements are of a common take-off hand, either a right or a left hand take-off, is that as a higher number of gauging elements is present along the predetermined gauge length, for example sixteen needles in a sixteenth gauge machine, which requires a looper block having at a minimum sixteen loopers along its length, the bills of the loopers are rocked toward and into engagement with the respective needle with which each such looper is associated, the loopers will tend to deflect in a common direction, between the needles to the right side, for example, which oftentimes can result in binding between the needles and loopers, or pinching the yarns therebetween due to this deflection, especially if the gauging elements are "oversized." If larger diameter yarns are used, the loopers will likely break or cut the yarns passing between the needles during the tufting process. This may also result in damage to the gauging elements themselves, whereupon the tufting machine must be shut down and the damaged gauging elements repaired or replaced, or yarns rethreaded and tied off, all of which greatly slows production rates and increases production costs. Even with the use of gauging modules, this problem still persists.

What is needed, therefore, is an improved tufting machine gauging element configuration in which larger gauge and easier to manufacture gauging elements of a gauge larger than the machine gauge, may be used in a close gauge machine. In particular, there is a need for an improved gauging element configuration in which the larger gauge needles of the front row of needles, for example, can be passed between the individual loopers of the rear series of loopers within a close gauge machine without binding or interfering with each other, and without otherwise cutting or breaking the yarns. There is also a need for an improved gauging element configuration in which the results of using larger gauging elements and larger diameter yarns can be attained, and which provide the benefits of a close gauge machine and the patterns and designs unique to close gauge machines in conventional tufting machines using larger diameter yarns at increased stitch rates and at increased production rates.

What would be desirable, therefore, but remains unattainable in the known art, is a dual shifting needle bar tufting machine using opposite hand gauging elements, for example needles and loopers, of a large gauge combined together into a close gauge, such that larger gauge gauging elements and larger diameter yarns can be used in a close gauge machine. What is also needed, but unavailable in the art, is a close gauge tufting machine using opposite hand gauging elements of a larger gauge on a dual shifting needle bar tufting machine in which the gauging elements, and in particular the loopers, will allow the large gauge needles of the front row of needles to penetrate the rear row of loopers without binding or interfering with one another, and which will also not tear or cut the large diameter yarns used in such a tufting operation.

SUMMARY OF THE INVENTION

The present invention provides an improved tufting machine gauging element configuration, in particular the needles and loopers used on a looped pile tufting machine, which overcomes a number of the design deficiencies of other gauging element configurations known in the art, and which represents a significant advance in the art. The improved tufting machine gauging element configuration of this invention provides a highly flexible gauging element configuration in which larger gauge needles and loopers may be used in a close gauge machine with larger diameter yarns which are more rugged and durable than close gauge yarns and gauging elements, while providing the graphics patterning features of a close gauge machine, particularly within a dual shifting needle bar "graphics" type tufting machine. This is all accomplished using gauging elements larger than the machine gauge and larger diameter yarns, which thus allows for less stitches per inch while still attaining the desired surface weight of the tufted article, i.e. carpets.

Moreover, as larger diameter yarns may now be used in a close gauge machine, less stitches are required which thus decreases production time and increases production rates, so that the tufting machine is now more efficient. The use of opposite hand tufting machine gauging elements minimizes the problems of yarn twist between the front and rear rows of tufted yarns, which, in conjunction with the use of larger yarns in the first instance, minimizes the problems of yarn twist even more so than heretofore known in the art.

Accordingly, the improved tufting machine gauging element configuration of this invention can be matched to the production needs of looped pile tufted article producers by allowing for the use of larger gauging elements and larger diameter yarns, at less stitches per inch, in close gauge machines to attain far greater production rates than those previously available in the art. This invention provides a simple and efficient tufting machine gauging element configuration for use with tufting machines which is well suited for use with a large number of tufted article types and configurations, and which can be easily retrofit to existing tufting machines.

This invention attains this high degree of flexibility, and precision, while maintaining simplicity in design and operation, by providing in the first instance an improved looper assembly comprising an elongate modular gauge block in which a plurality of elongate loopers, each looper having a proximal end and a spaced distal end, are embedded at their proximal ends. The loopers extend from, and at least partially along, the length of the gauge block. The loopers are formed into a first series of spaced loopers and a second alternating series of spaced loopers. Each one of the loopers of the first series of loopers is paired with an adjacent one of the loopers of a second series of loopers, respectively, to form spaced pairs of loopers extending at least partially along the length of the gauge block. In fashion totally unknown in the art, the loopers within each pair of loopers are spaced apart from one another a first distance, while the pairs of loopers may be spaced apart from one another a second distance different than the first distance. In a preferred embodiment adopted for use with close gauge machines, it is anticipated that the second distance between the pairs of loopers will be greater than the distance between the loopers within each such pair of loopers. However, the benefits of this improved tufting machine gauging element configuration can also be attained with larger gauge machines when, and if desired, it is entirely possible that the second distance between the pairs of loopers will be less than the distance between the loopers within each pair of loopers.

It is also anticipated, particularly in a close gauge machine, that the height of the loopers of the second series extending from the looper gauge block will be less than the height of the loopers of the first series, such that the second series of loopers will loop the accent or highlight yarns to a pile height greater than the loops of the base yarn caught on the loopers of the first series of loopers. It is possible, however, that the height of the loopers of the first and second series of loopers, respectively, can extend the same height from the looper block, it being anticipated that this construction will arise when the invention is used on a larger gauge tufting machine, i.e. a tufting machine having a gauge greater than ten is used.

Moreover, and in fashion heretofore unknown in the art, the loopers of the first series of loopers will have a ground bias point of a first take-off hand, for example a right take-off hand, wherein the loopers of the second series of loopers will have a ground bias point of a second opposite take-off hand, for example, a left hand. So constructed, these loopers are used with opposite hand needles positioned on the first and second needle bars, respectively. This allows for the distal ends, the bills, of the loopers within each pair of loopers to be deflected toward one another while striking their respective needles thus increasing the distance, at their distal ends, between the loopers of each adjacent pair of loopers to more easily allow for larger gauge gauging elements, i.e. needles, of the rear needle bar to pass between the loopers for the front needle bar, and to also allow larger diameter yarns to flow more easily through the looper gauge block such that the yarns are not otherwise caught or broken during the tufting operation.

The improved tufting machine gauging element configuration of this invention also contemplates the use of a first modular gauge block for being fastened to the first of the two dual shifting needle bars, with a first spaced series of elongate needles of a first take-off hand, for example a right hand, extending from and at least partially along the length of the first gauge block. Each of the needles has a proximal end fixedly embedded in the gauge block, and a needle point formed at its distal end. In similar fashion, a second elongate modular gauge block is provided for being fastened to the second dual shift needle bar, in which a second spaced series of elongate needles of a second take-off hand, for example a left take-off hand, extend, as well as extending at least partially along the length of the gauge block. Each needle of the second series of needles also has a proximal end fixedly embedded in its respective second gauge block. The first series of needles is spaced from and parallel to the second series of needles, the two series of needles combining together to form a third series of needles of a predetermined needle gauge, i.e., the gauge of the tufting machine closer than the gauge of either series of needles alone, extending along the first and second gauge blocks, respectively.

Used in conjunction with this improved needle configuration is the improved looper configuration described above, in which a plurality of spaced pairs of loopers are fixedly embedded at their proximal ends in a looper gauge block positioned with respect to the first and second gauge blocks, the loopers being formed into spaced pairs in which the spacing of the pairs of loopers may differ, and will differ, in close gauge machines, such that the respective loopers are spaced asymmetrically from each adjacent one of the loopers of the predetermined gauge extending along the length of the looper engage block. Within each pair of loopers will be a first looper having a right take-off hand, and a second looper of a left take-off hand, each of which corresponds to a pair of the needles within the machine gauge, such that as the respective loopers engage the respective needles, the bills of the loopers tend to deflect inward toward one another, thus increasing the gap between the pairs of loopers allowing for the use of larger gauging elements, i.e. needles, and the use of larger diameter yarns, than heretofore thought possible in the art. A feature of this construction, therefore, is that it provides a larger yarn flow area between the opposed yarn relief grooves of adjacent ones of the respective needles during the back stitch portion of the tufting cycle.

Again, an improved looper configuration in which the heights of the loopers within the first and second series of loopers differ may be used, such that the rear loopers, i.e. the second series of loopers, will pull the pattern or accent yarns to a looped pile height greater than the looped pile height of the base yarns tufted by the first series of loopers and first series of needles, respectively.

All this is possible within a close gauge machine using "larger" gauge gauging elements which, alone, are of a gauge greater than the machine gauge. For example, in one construction, the first series of needles may be of eighth gauge construction, whereas the rear series of needles may be of quarter gauge construction, for a combined twelve gauge tufting machine. In similar fashion, and so long as the first series of tufting machine gauging elements is an even multiple of the second series of tufting machine gauging elements, it is possible to produce a sixteen gauge tufted article using two eighth gauge needle bars and loopers, the eighth gauge gauging elements being easier and less expensive to manufacture than sixteen gauge elements, and allowing the use of a larger diameter yarn, which, with the novel gauging element configuration of this invention, allows for a sixteen gauge graphics type tufted article to be produced at a lower stitch count and at increased production rates than otherwise believed possible with current close gauge machines.

Accordingly, the objects of the present invention include the provision of an improved tufting machine gauging element configuration in which relatively large gauging elements can be used in a close or narrow machine gauge on a tufting machine, and particularly with a dual shift needle bar tufting machine. This allows for the use of larger diameter yarns which are more rugged and durable, i.e. are less prone to break during tufting, at reduced stitch counts for attaining the desired surface weight of the tufted article. Moreover, the improved needle and looper configuration of this invention allows for improved yarn twist treatment such that all the yarns of adjacent rows of tufted yarns tend to lean in a common direction, which minimizes the problems of any gaps or openings between the rows of tufts within the surface of the tufted article, and also allows for a more uniform, finished, denser appearing face on the tufted article. The invention accomplishes these objects, among others, while providing for an improved gauging element configuration of rugged and durable construction, which is inexpensive to manufacture and is easy to use, and which may be retrofit to existing tufting machines with maximum ease.

DETAILED DESCRIPTION OF THE PREFERRED EMBODIMENTS

Figure 1:
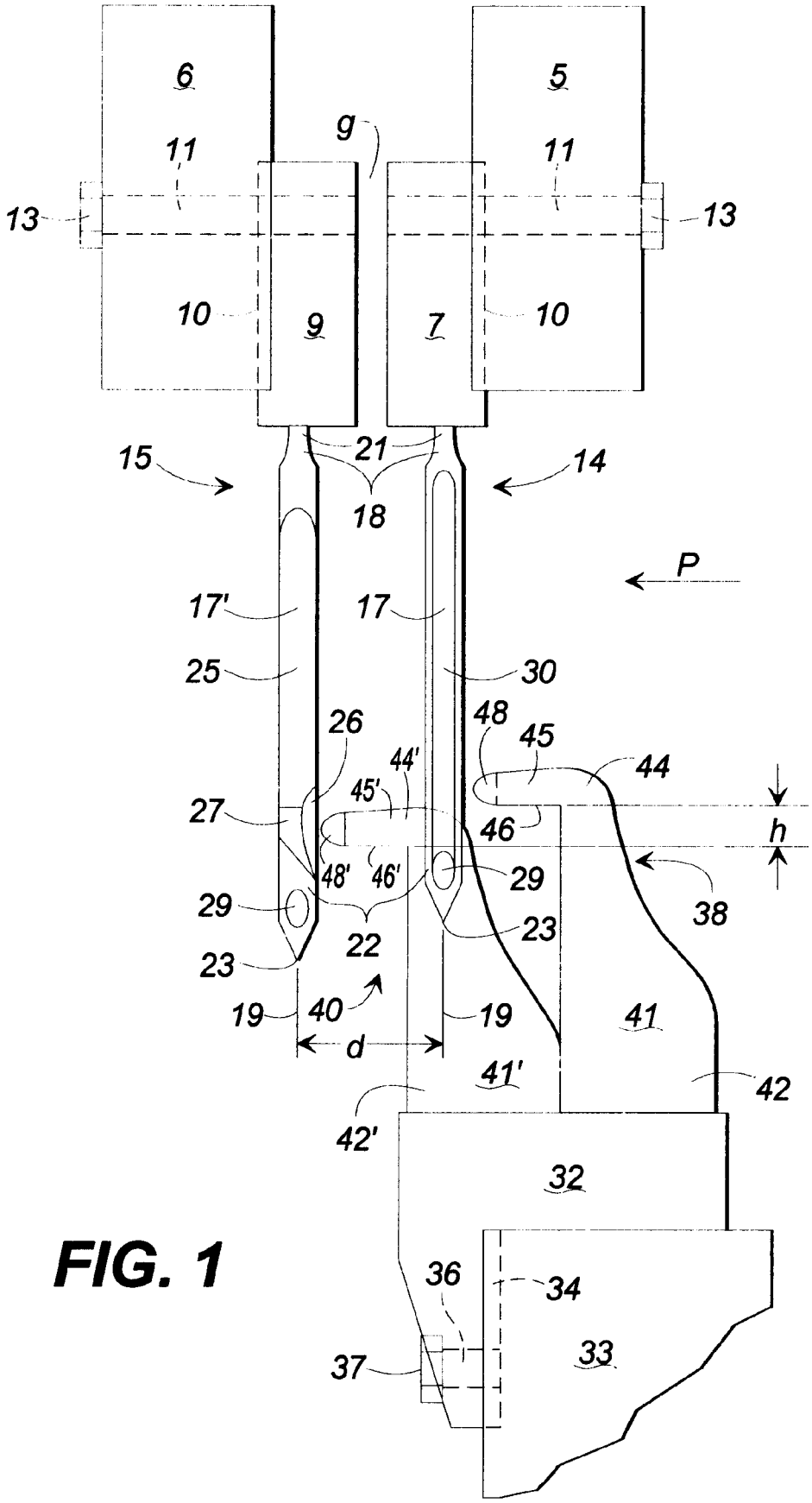
FIG. 1 is an end elevational view of the improved tufting machine needle and looper configuration of this invention on a dual shift needle bar looped pile tufting machine, showing the loopers in their respective yarn receiving positions.

Referring now to the drawings, in which like reference characters indicate like parts throughout the several views, a first needle bar 5, and a spaced parallel second needle bar 6 are illustrated. Needle bars 5 and 6 are each formed as a part of a conventional tufting machine (not illustrated), having a tufting machine main drive shaft (not illustrated) which reciprocates a series of push rods (not illustrated) which are attached to a common needle bar carrier (not illustrated), on which needle bars 5 and 6 are supported for lateral reciprocating movement or shifting with respect to one another across the width of the tufting machine. Such a construction is illustrated generally in U.S. Pat. No. 4,836,118 to Card et al., issued Jun. 6, 1989, and incorporated herein by this reference.

Figure 2:
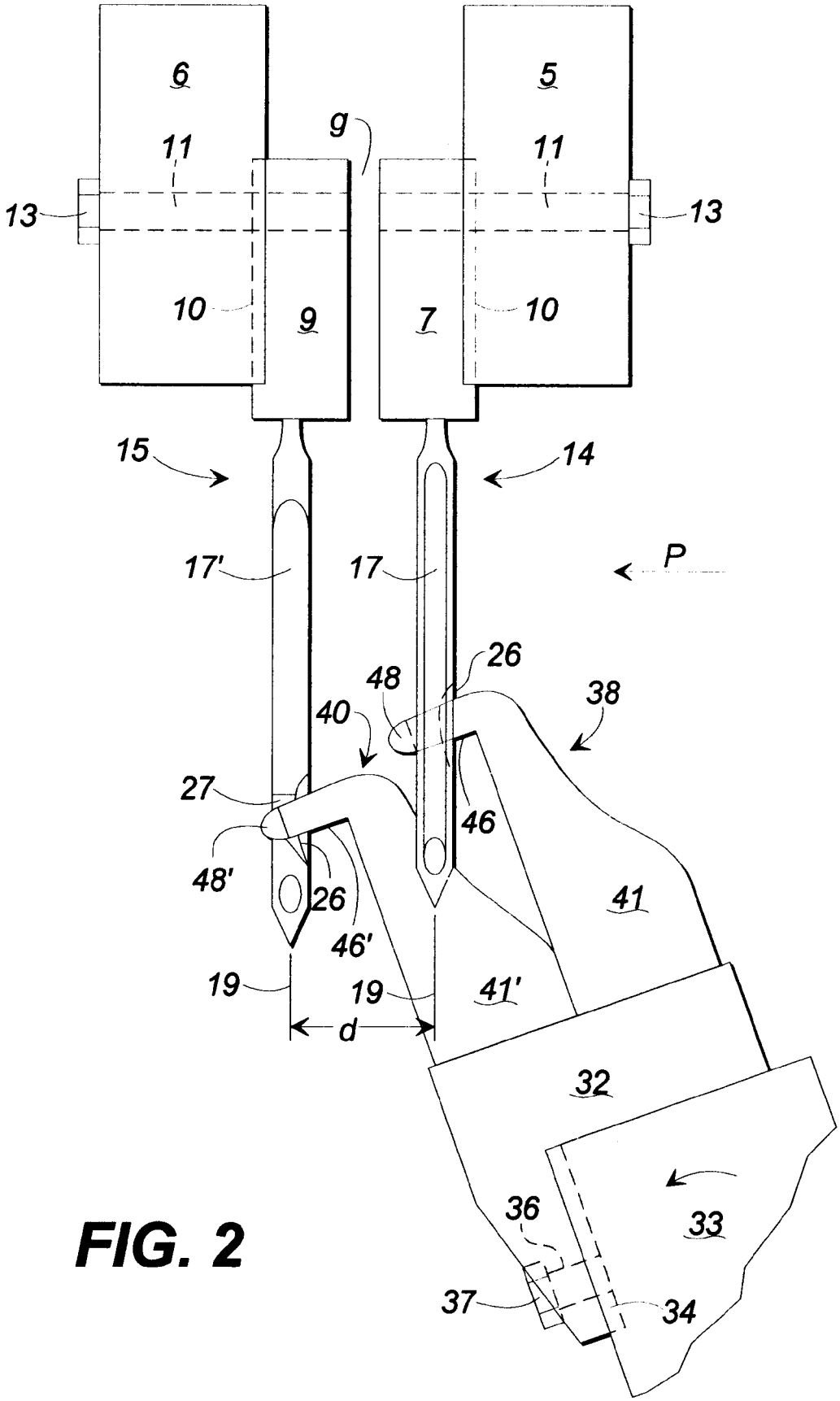
FIG. 2 is an end elevational view of the needle and looper configuration of FIG. 1, showing the loopers in their respective yarn engaging positions.

Mounted on first needle bar 5 is a first cast gauge block 7. Mounted on second needle bar 6 is a second cast gauge block 9. Each of gauge blocks 7 and 9 is a modular gauge block of the type disclosed in U.S. Pat. Nos. 5,295,450, and 5,400,727, to Neely, respectively, each of which is incorporated herein by this reference. So constructed, each of the gauge blocks 7, 9, has a guide element 10 received within a respective guide element receiving opening defined within the respective needle bars. Each gauge block 7, 9 includes a threaded axial opening 11 defined therein and through which a separate threaded fastener 13 is passed, a separate one of fasteners 13 securing the respective gauge blocks to the respective needle bars as shown in FIGS. 1 and 2. Gauge blocks 7, 9 will be cast gauge blocks, although it is possible that the gauge blocks could be machined if so desired.

As shown in FIGS. 1 through 6, the improved gauging element configuration of this invention includes a first, or front, series of needles 14 extending along gauge block 7, and a second, or rear, series of needles 15 extending along gauge block 9. Although only a single needle for each of series 14, 15, respectively, is shown in FIGS. 1 and 2, it is understood by those skilled in the art, and as illustrated generally in the aforementioned patents to Neely, that a spaced series of needles extends along the length of the respective gauge blocks, the number of needles on each gauge block being of a predetermined gauge. For example, although not illustrated herein, it is anticipated that the first series of needles 14 could be of a one-eighth inch gauge, assuming the gauging distance is one inch, and the rear series of needles 15 may be of a quarter inch gauge, the two series of needles combining together to form a third twelve gauge series of needles 52 (FIGS. 3 through 6) of a "close" twelfth gauge.

Both series of needles 14, 15 are therefore comprised of a plurality of substantially identical needles 17, 17' of the desired gauge and spacing. Each needle 17, 17' includes a needle shank 18 formed about a longitudinal center line 19 such that the needle extends away from its respective gauge block. Each needle 17 has a proximal end 21 fixedly embedded in its respective gauge block at the time the gauge block is cast, and a spaced distal end 22 at which a needle point 23 is defined. Each needle also includes a generally planar blade 25 formed along one side thereof intermediate its proximal and distal ends, with a target area 26 defined in the side of the needle along which the blade lies, positioned toward the distal end of the needle. Adjacent the target area is a pick-up area 27 sized and shaped such that the bill of an appropriate looper may slidably pass over the target area, and along the pick-up area for receiving a yarn passed (not illustrated) through the eye of a respective needle in known fashion. Each of needles 17 of the front series of needles is provided with a right-hand take-off, and needles 17' of the rear series of needles each have a left-hand take-off. The take-off hand, of course, is determined by the orientation of the target area 26 and pick up area 27 of each needle with respect to the side of the needle the looper bill contacts while receiving the yarn from the needle. These take-off hands may be reversed when and as desired, but the take-off hand of the front and rear series of needles, respectively, will be of opposite hand with respect to one another.

As shown in FIGS. 1 and 2, defined in the side of each needle 17, 17' opposite blade 25 is an elongate yarn protection groove 30 which is sized and shaped to partially house and protect the yarn passed through the needle eye to minimize the prospect of adjacent loopers and/or needles otherwise striking, catching, or breaking the yarn during the tufting cycle, at which point in time a yarn Y (FIGS. 3 through 6) moves or flows through the yarn protection groove as the needles move upwardly through a backing material (not illustrated) which extends transversely beneath the needles and above the loopers 41 of the tufting machine, in known fashion.

Positioned with respect to gauge blocks 7, 9 is a third cast gauge block 32, a looper gauge block, mounted to a looper block gauge bar 33 in the fashion illustrated in U.S. Pat. No. 5,513,586 to *Neely* et al., issued May 7, 1996, and incorporated herein by this reference. Although not illustrated in greater detail herein, looper block gauge bar 33 will be mounted to a rocker arm, which in turn will be fastened to a looper drive shaft (not illustrated), the looper drive shaft being rocked in timed relationship with the rotation of the tufting machine main drive shaft such that the loopers move toward and into engagement with the needles of the front and rear series of needles 14, 15, respectively, as the needles are in their bottom dead center position shown in FIGS. 1 and 2.

Looper gauge block 32 is constructed in fashion similar to gauge blocks 7, 9, as more fully disclosed in U.S. Pat. Nos. 5,295,450, and 5,400,727, to Neely, and is thus cast to include a guide element 34 received within a guide element receiving opening (not illustrated) defined within the looper block gauge bar 33, and in which an axial opening 36 is threadably defined so that a threaded fastener 37 may be passed therethrough for threadably securing looper gauge block 32 to looper block gauge bar 33.

As shown in FIGS. 1 through 6, a first or front series of loopers 38, and a spaced parallel second or rear series of loopers 40 are embedded within looper gauge block 32. Each series of loopers 38, 40 is comprised of a spaced series of loopers 41, 41' each being of substantially identical construction with minor exception, as noted hereinbelow. Each looper thus has a proximal end 42, 42' fixedly embedded within looper gauge block 32, and a spaced distal end 44, 44' at which a looper bill 45, 45' is defined. In known fashion looper bill defines an elongate transverse looper throat 46, 46' with respect to the height of the respective loopers, and includes either a right-hand or a left-hand ground bias point 48, 48' at the tip of each respective bill 45. As best shown in FIGS. 3 through 6, the loopers of the first series of loopers 38 include a right hand ground bias point 48, whereas the loopers 41 of the second series of loopers 40 include a left hand ground bias point 48'. The take-off hands of these loopers will be of the same take-off hands of the corresponding one of needles 17, 17' with which the respective loopers are paired. The ground bias point is formed by grinding a portion of the thickness of the looper away so that a leading or knife edge bias point is created for the purpose being aligned with the center line T of target area 26 with the respective of one of the needles with which that looper is associated.

Accordingly, each of the needles of the first series of needles 14 is shown in FIGS. 3 through 6 with a right take-off hand such that the target area 26 and pick-up area 27 of each one of the needles within the front series of needles is defined on the right hand side of the needle, measured with respect to the direction in which the backing material is advanced through the tufting machine, as illustrated in FIGS. 1 and 2. Each of the needles 17' of the second series of needles 15, however, has an opposite left take-off hand. So constructed, each of the needles of the first series of needles 14, and each of the loopers of the first series of loopers 38 has a right take-off hand, and each of the needles of the second series of needles 15, and each of the loopers of the second series of loopers 40 has a left take-off hand. As rows of yarn are being tufted, therefore, the yarns tufted by the first series of needles 14 will tend to have a common twist oriented in a first direction, whereas the yarns tufted by the rear series of needles 15 will tend to have an twist oriented in a direction different than the direction of the first twist, i.e. an "opposite hand twist." However, since these hands are opposite one another in terms of how the respective gauge blocks 7, 9 are mounted on the needle bars 5, 6, respectively, the yarn twist will thus lie in a common direction from row to row such that any problems of gapping or spacing between adjacent rows of tufted yarns will be minimized by this configuration. An additional feature of this construction is that the loopers 41, 41' as shown by the directional arrows in FIG. 3, will tend to deflect inwardly toward one another within each pair of loopers 50 (FIGS. 3 through 6) formed along the length of the looper gauge block 32, thus opening up the space between adjacent pairs of loopers such that the needles of the rear series of needles 15 may pass more easily between the loopers of the front series of loopers 38 in fashion heretofore unknown in the art, especially when larger gauge needles and loopers are used on a close gauge tufting machine.

Referring now to FIGS. 3 through 6, each looper 41' of the second series of loopers 40 is paired with an adjacent one of the loopers 41 of the first series of loopers 38 to form pairs 50 of loopers extending along the length of looper gauge block 32. This is illustrated generally in FIG. 2 of the aforementioned U.S. Pat. Nos. 5,205,450, and 5,400,727 to Neely. Therefore, only a portion of the two spaced series of loopers extending along the length of looper gauge block 32 are illustrated in FIGS. 3 through 6.

In FIG. 1, the front and rear loopers are shown in their respective yarn receiving positions at the bottom dead center position of the needles during the tufting operation. This equates to the position at which needles 17, 17' are in their downmost extended position, having penetrated the backing material (not illustrated) with the yarns (not illustrated) carried through eyes 29 thereof. A yarn will extend downward within yarn protection groove 30 on one side of each needle 17, 17', through eye 29, and extend upward along the blade 25 on the opposite side of the respective needle. Each of the yarns is fed by an appropriate and otherwise conventional yarn feed mechanism, which, for a graphics-type machine, will include separate front and rear yarn feed mechanisms for the yarns of the front and the rear needles, respectively. Thus, and as shown in FIG. 1, the first series of loopers 38 is positioned with respect to the first series of needles 14, and the second series of loopers 40 is positioned with respect to the second series of needles 15, with the first series of needles 14 extending between adjacent ones of the loopers 41 of the second series of loopers.

In FIG. 2, loopers 41, 41' are shown in their yarn engaging positions in which the ground bias points of each respective looper have passed over a respective one of the target areas 26, and along the pick-up areas 27 of the respective needles 17, 17', so that the yarns (not illustrated) passed through eyes 29 will be received against throats 46, 46' which will hold the yarns as the needles move from the bottom dead center position illustrated in FIGS. 1 and 2, to their uppermost position in which they have been withdrawn upward through the backing material (not illustrated) such that a looped pile of yarn (not illustrated) is formed. Once the needles have been withdrawn to their top dead center position, looper gauge block 33 is simultaneously rocked back into the yarn receiving position shown in FIG. 1, so that the loops of yarn are allowed to pass off of the throats of the respective loopers as the backing material advances through the tufting machine, in known fashion.

In the embodiment of the invention shown in FIGS. 1 and 2, gauge block 7 is spaced from gauge block 9 by a distance of approximately one-sixteenth of an inch, as denoted generally by the reference character "g." A distance, denoted by the reference character "d" of one-quarter inch is present between the longitudinal center lines 19 extending downward through each of needles 17, 17'. Each one of the loopers 41, 41' will be spaced from its respective needle 17 by approximately one-sixteenth of an inch in the yarn receiving position shown in FIG. 1.

In many respects, the series of needles 14, 15, and series of loopers 38, 40 illustrated in FIGS. 1 and 2 resemble conventional needle and looper configurations. However, in fashion heretofore unknown in the art, these configurations are being used in tufting machines of ten gauge, and smaller, thus comprising a close or narrow gauge machine. This is accomplished by using needles 17, 17', and loopers 41, 41', of a gauge larger than the close gauge of the machine. For example, it is anticipated that if the needle and looper configurations shown in FIGS. 1 through 6 are used with a ten gauge machine, each series of needles 14, 15 would be a five gauge series of needles, the two series of needles being combined into a third series of needles 52, as shown in FIGS. 3 through 6, of the requisite gauge. Additional gauge combinations, therefore, could be a twelve gauge machine using a one-eighth gauge series of needles 14 and a quarter gauge series of needles 15, or using two one-sixth gauge series of needles, a fourteen gauge machine using two seven gauge series of needles, and a sixteen gauge machine using two one-eighth gauge series of needles 14, 15. The spacing of the needles 17 of the respective front and rear series of needles 14, 15, in FIGS. 3 through 6 represents an "even" gauge tufting machine in which, for example, the third series of needles 52 is of sixteenth gauge, whereas the series of needles 14, 15 are each of a one-eighth gauge in which the needles are on one-eight inch centers from one another with respect to each adjacent needle within each of the front and rear series of needles 14, 15.

The unique advantage of this invention, therefore, is that two series of needles 14, 15, each of a relatively large gauge, i.e. larger than a ten gauge, can be used in combination to form a relatively close or narrow gauge tufted product. This therefore allows for the use of larger gauge needles, which are easier and less expensive to manufacture, larger diameter yarns, which are less expensive to manufacture and which tend to provide greater surface coverage and to be more durable, i.e. they are less prone to snap or break during tufting, resulting in a lower stitch count per unit length of the tufted article to produce a tufted article of the desired surface weight when contrasted with the relatively more expensive and fragile needles, small diameter yarns, loopers, and increased stitch counts associated with conventional close gauge tufting machines.

In order to attain these benefits, the spacing between the loopers within each pair of loopers, and the spacing between the pairs of loopers is controlled in accordance with the position of the center line T of each target area 26 of each respective needle 17, 17', as described below.

Figure 3:
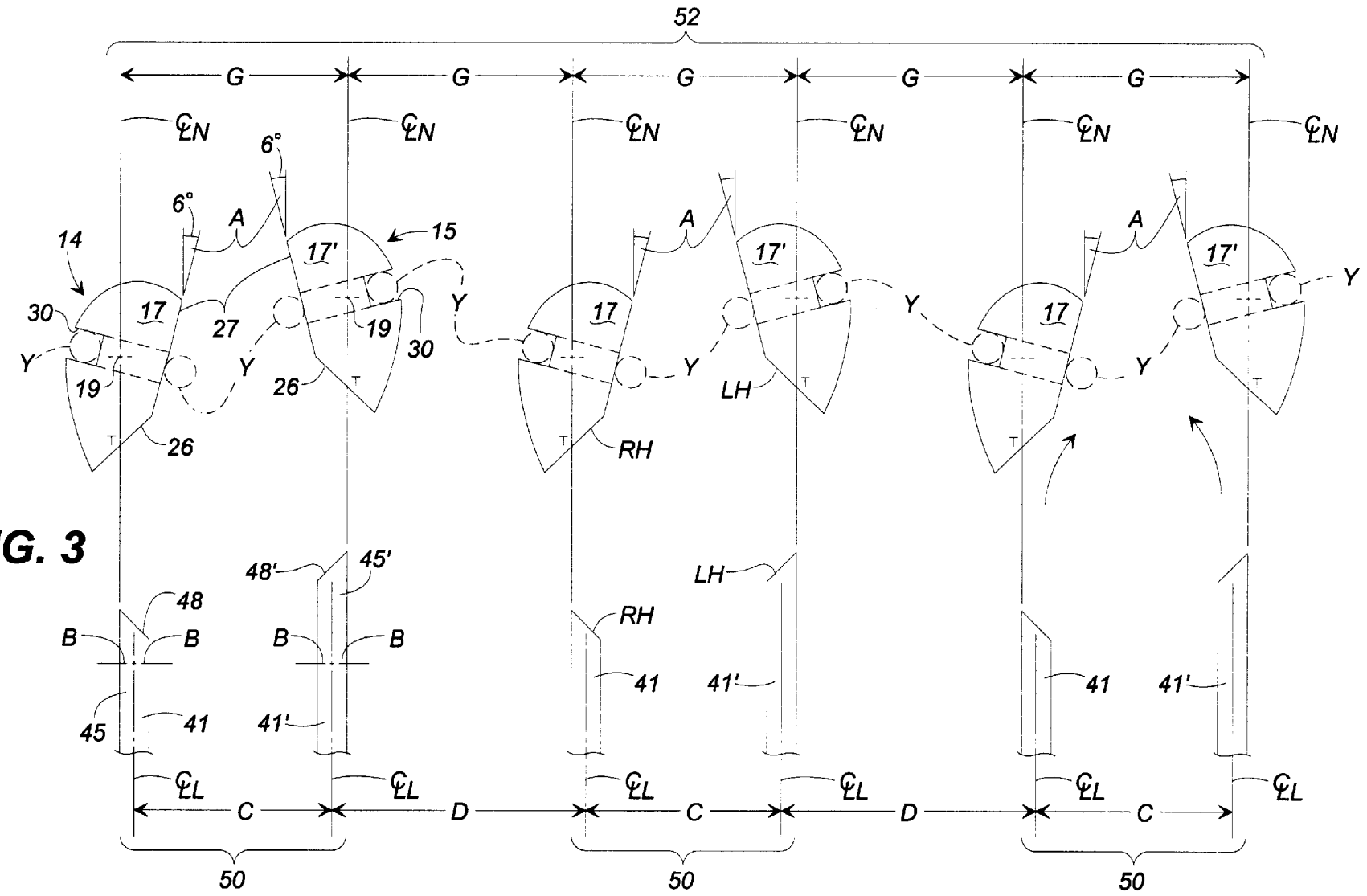
FIG. 3 is a top plan view, in partial cross-section, of a first embodiment of the improved needle and looper configurations of the invention.

For purposes of clarity, in FIG. 3 each pair of loopers 50 is backed away from its respective pair of needles 17, the correct positioning of the loopers with respect to the needles being shown in FIGS. 1 and 2. Accordingly, in FIG. 3, the needles 17 of the first series of needles 14, and the needles 17' of the second series of needles 15, are shown combined together into a third series of needles 52 of the desired gauge. In this instance, an "even" gauge is being used in which there is a like number of needles of the first series of needles 14 as there are needles of the second series of needles 15. This would equate to a gauge of ten, twelve, fourteen, sixteen, or even twenty, on the tufting machine. All that is required, however, for any desired gauge combination is that the number of needles 17, and loopers 41, of the first series of needles and loopers, respectively, be an even multiple of the number of needles 17' and/or loopers 41' of the second or rear series of needles and/or loopers, respectively.

Thus, and for example, were the tufting machine to use a twelve gauge configuration, it is possible that the first series of needles 14 could be a one-eighth gauge series of needles, whereas the second series of needles 15 would be a quarter inch gauge series of needles for a combined twelve gauge machine. Two relatively "large" gauges, therefore, are used in combination for a resultant close gauge. However, the loopers could still be provided in a sixteen gauge in that only every other one of the loopers 41' of the second series of loopers 40 will be used with the needles of the rear series of needles 15, every other such looper being a "surplus" looper which can be left in position in the event it is desired to change gauge blocks 9 from a four, or quarter, gauge to an eighth gauge to provide a sixteen gauge tufting machine, for example. This construction, therefore, allows for far more rapid changeover, and flexibility, in tufting machine operations, especially in gauge setting with close gauge machines, than heretofore known in the art. Moreover, when this construction is combined with the embedding of the proximal ends of the respective needles 17, 17' within gauge blocks 7, 9, respectively, and of loopers 41, 41' within looper gauge block 32, the necessity of precisely aligning the respective needles and loopers within the respective gauge blocks one at a time, and securing these gauging elements in position with set screws, or the like, is thus eliminated, which also allows for far more rapid changeover, and a greater degree of precision and control, than previously attainable in the art.

Still referring to FIG. 3, then, each of needles 17, 17' is rotated through a torsion angle A of six degrees with respect to each of loopers 41, 41'. This angle is measured by the angle of blade 25 (FIGS. 1, 2) of each needle 17 is with respect to a lateral needle center line $C_{LN}$. In the configuration of the invention in FIG. 3, i.e. a torsion angle of six degrees, it just so happens that the lateral needle center line $C_{LN}$ passes through the center line, denoted by the reference character "T," of each target area 26, although this is not a requisite. The leading edge of each ground bias point of each respective looper thus lies along the center line T of target area 26, such that the center line of each looper, denoted by reference character "$C_{LL}$," is offset from the target center line T by a distance denoted by the reference character "B," each looper having a width equal to 2B. Accordingly, as seen in FIG. 3, the distance "C" between the loopers within each pair of loopers 50 is measured from the center line $C_{LL}$ of a looper 41 to the adjacent looper 41', and distance D between the pairs of loopers is measured between the adjacent pairs of loopers, in series along the length of looper gauge block 32. In FIG. 3, distance C is equal to the gauge, denoted by the reference character "G," which extends between each lateral needle center line $C_{LN}$, less 2B, as set forth in the mathematical equation:

$$C=G-2B.$$

The distance "D," measured between pairs of loopers 50, is equal to G+2B, as represented in the mathematical equation:

$$C=G+2B.$$

Accordingly, distance C is less than distance D by 4B, which is equal to the full thickness of two loopers placed next to one another. As shown in FIG. 3, therefore, distance D creates a gap which is no less than distance C plus the thickness of two loopers which allows for the use of the larger gauge needles used with this configuration, for example eighth gauge needles combined in a sixteen gauge machine. In particular, the needles of the rear series of needles 15 that are received between the loopers of the first series of loopers 38 are given enough space to pass into the gap, measured by distance D which is greater than the gauge distance, without otherwise binding the needles and loopers together, and without catching or snagging the yarns of the rear series of needles on the bills of the first series of loopers. Accordingly, larger diameter yarns can now be used with larger gauge gauging elements in a close gauge construction. This is new in the art.

Additionally, when the loopers, and in particular their ground bias points 48, 48', engage their respective target areas 26, the distal ends 44, 44' (FIGS. 1, 2) of each looper 41, 41' tend to deflect inwardly toward one another within each pair of loopers 50, which tends to widen the gap between the opposed and spaced loopers of each adjacent pair of loopers 50 along the length of looper gauge block 32, providing further tolerance for the larger gauge needles, larger diameter yarns, and larger gauge loopers used in this novel needle and looper configuration. Therefore, in FIG. 3, distance C is less than distance D by the thickness of two loopers, distance C is less than the gauge of the machine, and distance D is greater than the gauge of the machine.

As shown in FIGS. 3 through 6, each pair of loopers 50 includes a looper in the first series of loopers 38 having a right hand take-off bias point 48, and an opposed looper in the second series of loopers of a left hand take-off bias point 48'. These two loopers within each such pair of loopers are received on the right hand take-off target area 26, and the left hand target area 26 of the needles 17, 17' of the first and second series of needles 14, 15, respectively. This configuration, in combination with the looper spacing described below, is totally new to the art, and solves the age old problem of differential yarn twist while also allowing for the use of larger gauge needles and loopers in a close gauge looped pile tufting machine with large diameter yarns, at decreased stitch rates, and thus at increased production rates.

Figure 4:
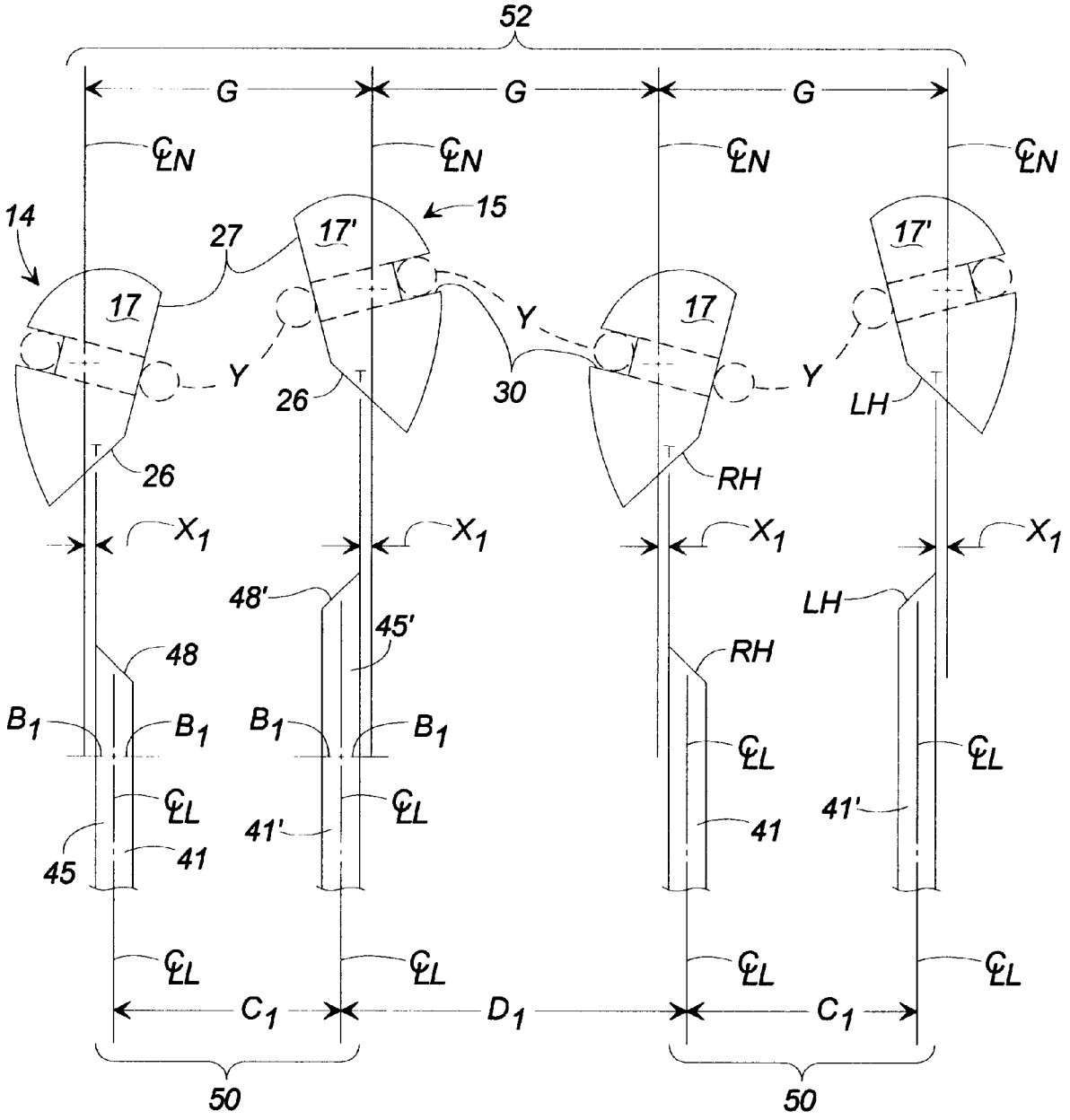
FIG. 4 is a top plan view, in partial cross-section, of a second embodiment of the improved needle and looper configurations of the invention.

An alternate embodiment of the novel needle and looper configuration of this invention, is shown in FIG. 4. In FIG. 4, the center line T of target area 26 is offset with respect to the lateral needle center line $C_{LN}$, by an amount designated as $X_1$. All that is important for this discussion of the embodiment of the invention is to realize that the center line T of target 26 is offset inwardly of the lateral needle center lines $C_{LN}$ so that the two corresponding targets T on needles 17 of first series 14 and second series 15 of needles, respectively, are moved toward one another and fall within the gauge distance G of the needle configuration. Accordingly, in this embodiment of the invention, distance $C_1$ between the loopers within each pair of loopers equals the gauge less twice the offset, $X_1$, less twice the half thickness of a looper, $B_1$, which is represented in the mathematical equation:

$$C_1=G-2X_1-2B_1.$$

Conversely, the distance $D_1$ between the pairs 50 of loopers is now equal to the gauge G, plus twice the offset $X_1$, plus twice the half thickness of a looper, $B_1$, and is represented by the equation:

$$D_1=G+2X_1+2B_1.$$

Accordingly, in this embodiment of the invention, distance $D_1$ is greater than $C_1$ by no less than the thickness of two loopers, 4$B_1$, plus four times the offset of the target center line T from the lateral needle center line $C_{LN}$, 4$X_1$. However, no matter the amount of offset from T, in this embodiment, as with the first embodiment illustrated in FIG. 3, the distance between the pairs of loopers, $D_1$ is no less than the distance between the loopers within the pairs of loopers, $C_1$, plus the thickness of two loopers, 4$B_1$. Here, for the reasons described above, distance $D_1$ is greater than $C_1$ by an additional factor of 4$X_1$, or four times the cumulative offset of the target center line T from the needle center line. The more the center line T of the target moves inwardly of the lateral needle center lines $C_{LN}$, the larger the gap, or distance, between the pairs of loopers becomes, so that even more space is provided for the passage of yarns Y within yarn protection grooves 30, and for the passage of a relatively large gauge needle 17 of the first, or front, series of needles 14 between adjacent ones of loopers 41' of the second, or rear, series of loopers 40 of this improved gauging element configuration.

Figure 5:
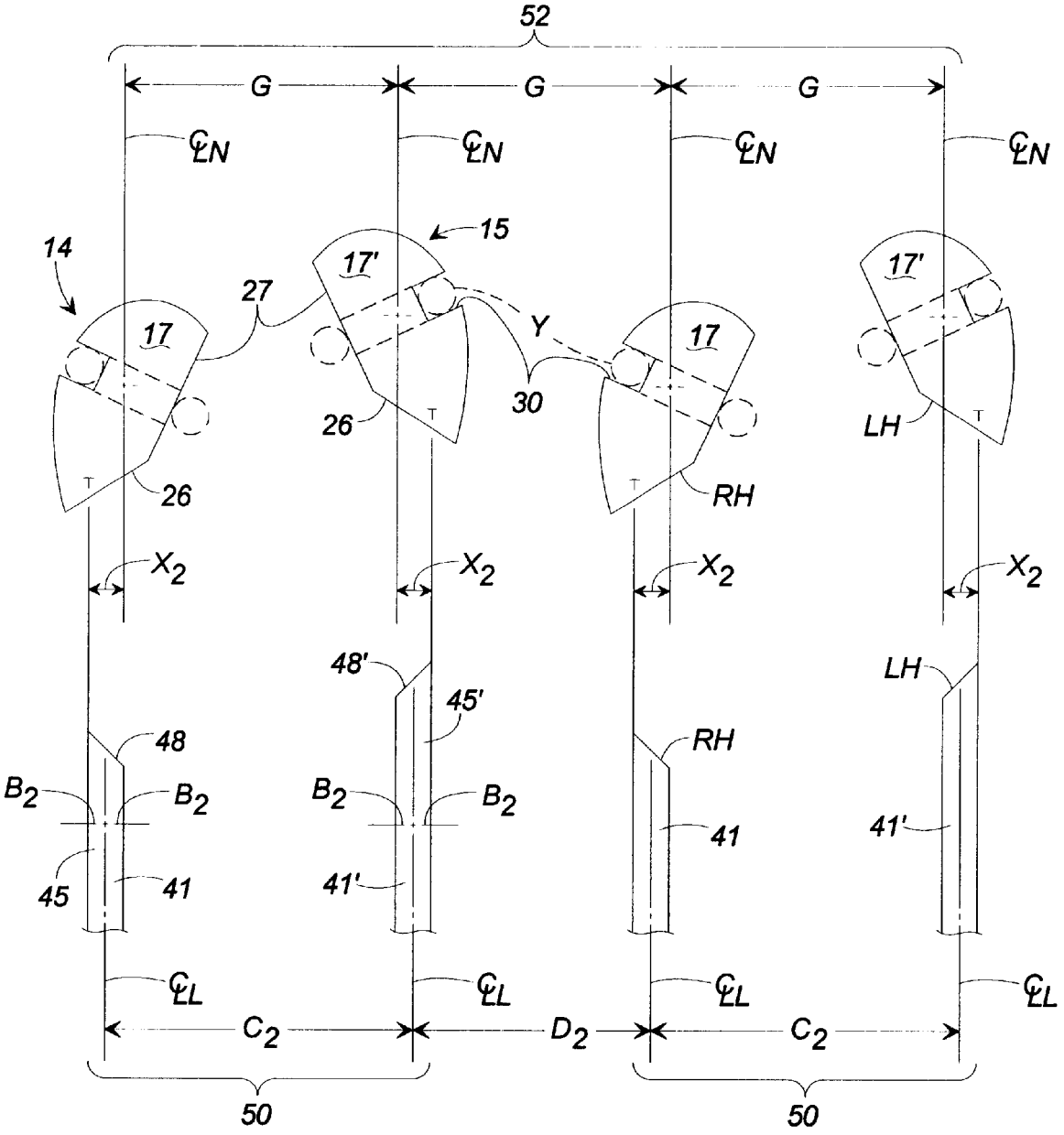
FIG. 5 is a top plan view, in partial cross-section, of a third embodiment of the improved needle and looper configurations of the present invention.

A third embodiment of the improved gauging element configuration of this invention is illustrated in FIG. 5, which illustrates how the spacing is affected when the center line T of the target 26 is moved outside of the lateral needle center lines $C_{LN}$, in which event the distance between the pairs of loopers becomes less than the distance between the loopers within each pair of loopers. Although this is not desired in the preferred configuration of FIGS. 3 and 4, this type of construction may prove to be suitable, where, for example, the improved needle and looper configuration of this invention is used in a large gauge machine, i.e. a machine having a gauge greater than ten, in which event more than adequate space will be provided for the passage of the rear needles between the front series of loopers, and where the concern of the loopers pinching the yarns on the yarn protection groove 30 side of needle 17 is not as great a concern as it is in a close gauge machine.

Accordingly, as shown in FIG. 5, the center line T of target 26 is offset outside of lateral needle center line $C_{LN}$ by an offset designated as $X_2$. Distance $C_2$, the distance between the loopers within each pair of loopers, is thus equal to the gauge distance G plus twice the offset, $2X_2$, less twice the half thickness of a looper, $2B_2$, which is represented in the mathematical equation:

$$C_2=G+2X_2-2B_2.$$

The distance $D_2$ between the pairs of loopers 50 is now equal to gauge, G, less twice the offset, $2X_2$, plus twice the half thickness of the looper, $2B_2$, represented by mathematical equation:

$$D_2=G-2X_2+2B_2.$$

In this embodiment of the invention, therefore, the distance $C_2$ between the loopers within each pair of loopers 50 is greater than the gauge distance, and the distance $D_2$ between each adjacent pair of loopers is less than the gauge distance. The distance $C_2$ between the loopers within the pair of loopers is at least the full thickness of two loopers greater than the distance $D_2$, or stated conversely, $D_2$ is no greater than $C_2$ less the thickness of two loopers 41, 41'.

As discussed above, this embodiment is not preferred where a large gauge needles and/or loopers are being used in conjunction with a close gauge machine, as this narrows the gap, or distance, $D_2$, between adjacent pairs 50 of loopers in an undesirable fashion. However, if a larger gauge machine is being used in the first instance, this may be of little concern, and still allows for the benefits of this construction, in which the distal ends 45, 45' of the loopers will deflect inwardly toward one another, increasing the distance $D_2$ between each pair of loopers 50 for improved yarn flow in the space between the needles defined by their respective sides containing the yarn relief grooves 30, and the right hand, left hand take-off configuration still allows for uniform yarn twist in the face of the tufted article.

Figure 6:
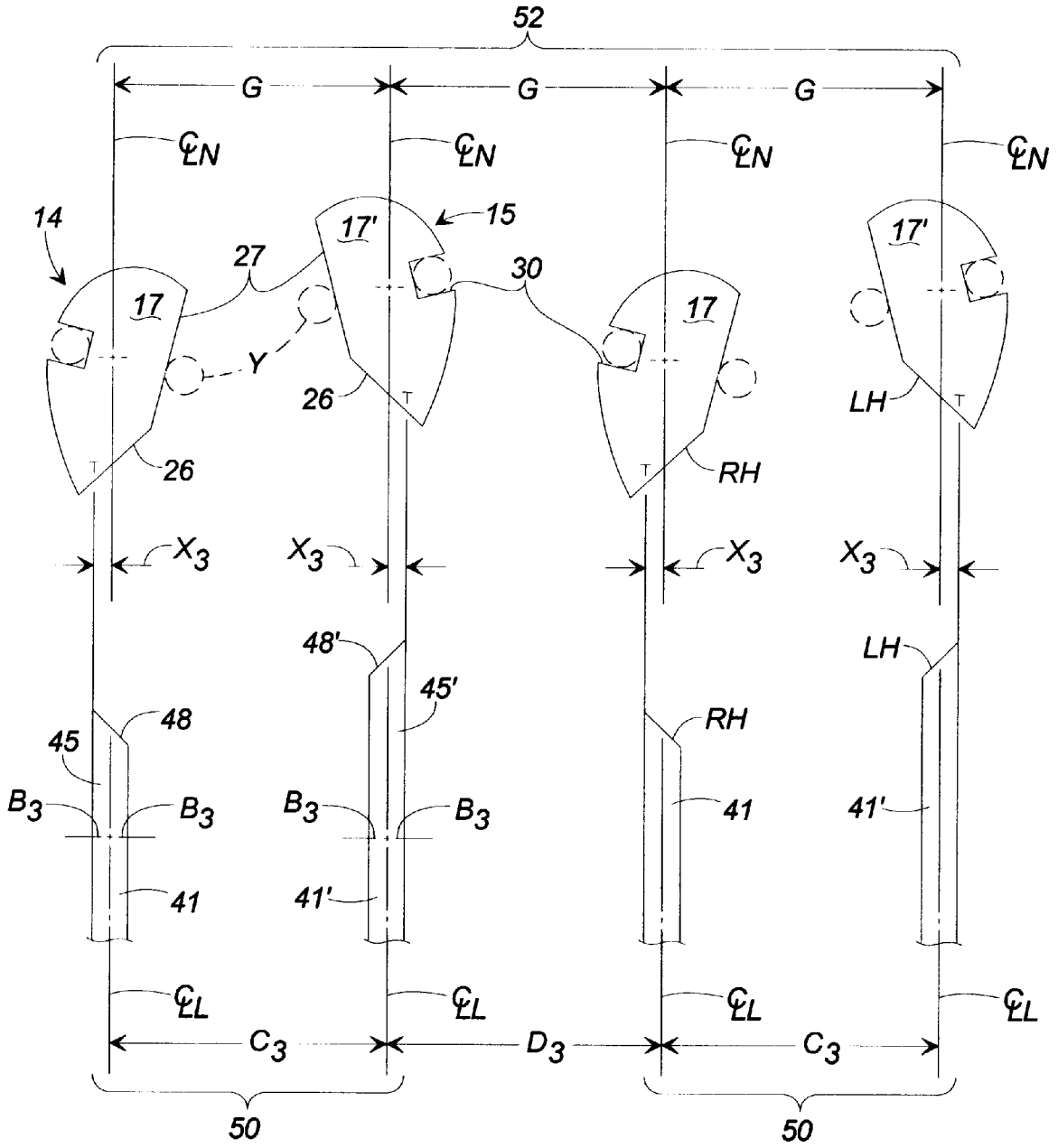
FIG. 6 is a top plan view, in partial cross-section, of a fourth embodiment of the improved needle and looper configurations of the present invention.

FIG. 6 illustrates the rare instance in which the center line T of the target 26 is placed outside of the lateral needle center line $C_{LN}$, but where the offset of the target center line T from the needle center line, $X_3$ is equal to half the thickness of a looper, $B_3$ ($X_3=B_3$). In this embodiment, therefore, distance $C_3$ between the loopers 41 within each pair of loopers 50, is equal to gauge, G, plus $2X_3$, minus twice the half thickness of the looper, $B_3$, represented by the mathematical equation:

$$C_3=G+2X_3-2B_3.$$

The distance $D_3$ between each pair of loopers 50, therefore, is equal to the gauge, less twice the offset, $X_3$, plus twice the looper half thickness, $B_3$, represented by the mathematical equation:

$$D_3=G-2X_3+2B_3.$$

It can be seen, therefore, that in this embodiment of the invention C equals D equals gauge, and in fact a symmetrical spacing of the loopers with respect to one another along the length of looper gauge block 32 is provided. Again, this embodiment is not necessarily preferred in a close gauge machine, rather this embodiment is preferred for a larger gauge machine in which the benefits of the right hand/left hand take-off of the needles, and the corresponding right hand/left hand take-off of the loopers is provided, which minimizes the differences in yarn twist, i.e. yarn treatment, during the tufting of the yarns by the tufting machine, and does improve, to the extent of the deflection of the ground bias points 48, 48' of each looper 41, 41' inwardly toward one another within each pair of loopers 50, the passage, or flow, of the yarns Y through the yarn relief grooves 30 between each needle of the rear series of needles, respectively, within the front series of loopers.

As illustrated by the preferred embodiments of FIGS. 3 and 4, therefore, which are anticipated for the use of large gauge tufting elements, i.e. needles and loopers in this instance, in a close gauge machine, the benefits of corresponding right hand and left hand take-offs for uniform yarn twists, or treatment, are provided; larger gauge needles and loopers, which cost less to manufacture, are used; larger diameter yarns, which cost less to manufacture, and are more durable, are used; and less stitches are required to achieve the same surface weight of the tufted article in a close gauge machine in which finer patterns or graphics treatments can be applied, at a greater stitch rate, and at improved production rates than otherwise available in conventional close gauge tufting machines.

When the improved needle and looper configuration of this invention is used in a close gauge machine, the possibility does exist that due to the spacing between the loopers within each pair of loopers that the loopers of the front row of loopers 38 may interfere with the loopers of the rear row or series of loopers 38, such that it is desirable to stagger the height of the loopers of the first (front) series with respect to the loopers of the second (rear) series. This is accomplished, as shown in FIGS. 1 and 2, by lowering the height of the loopers 41' of the second series of loopers 40 with respect to the height of the loopers 41 of the first series of loopers 38. This offset height, measured from throat to throat, is designated by the reference character "h" in FIG. 1. All that is required is that this offset height be sufficient to allow the bills 45 of the loopers of the front series of loopers to clear the bills 45' of the loopers of the rear series of loopers when the loopers are deflected toward one another within each pair of loopers 50. This will prevent the bill of the front series of loopers from striking the bill of the rear series of loopers, and allows the loopers sufficient flexibility and range to sweep along the needle target and pick-up areas to loop the front, or base, yarns.

A unique benefit of this construction, however, is that as the second series of loopers is typically used with the accent or highlight yarns of the graphic design within the tufted article being produced, it is oftentimes desirable to bring these tufts to a greater height within the surface of the tufted article than the loops of the base material tufted by the first series of loopers 38 in conjunction with the first series of needles 14. Accordingly, and as carpet is tufted upside down, the lower height of the loopers of the second series of loopers 40 results in a greater looped pile height of the accent or pattern yarns (not illustrated) in the face of the tufted article i(not illustrated) when compared to the height of the loops of the base fabric tufted by the first series of loopers and needles. The only requirement of this construction is that the length of the needles 17 of the second series of needles 15 be increased by this offset amount, h, so that the loopers of the first and second series of loopers, respectively, properly align with the needles of the first and second series of needles, respectively. Moreover, the distance from the leading edge of ground bias point 48' of the second or rear series of loopers 40, will be offset from the leading edge of the ground bias point 48 of the first series of loopers 38 by the distance between the longitudinal center lines of the needles, d, as shown in FIGS. 1 and 2.

The use of larger gauge tufting elements in a close gauge machine may possibly be accomplished without the benefit of this invention, where the distance d between the needle points 23 of the needles 17 of the first and second series of needles 14, 15, respectively, is greater than a quarter inch. So constructed, it may be possible that a sufficient amount of space between the pairs of loopers exists within which the first and second series of needles and loopers, respectively, may engage one another without the problems of interference. This, however, has the drawback of creating a relatively large gap between the tufted rows of yarns, and thus increases the likelihood that there will be visible gaps or spaces between each adjacent row within the face of the tufted article, which may be undesirable from a surface finish standpoint. However, such a needle and looper configuration, e.g. that of FIGS. 5 and 6, can be used to fabricate the tufted article to attain the improved treatment of yarn twist and the reduced stitch rate provided by such a construction, and the use of larger diameter yarns.

In use, a plurality of gauge blocks, or modules, 7 having a front series of needles 14 of a desired gauge, will be fastened to first needle bar 5. A second gauge block 9 having a second or rear series of needles 15 of a second gauge, which could be less than or equal to the gauge of the first series of needles, is fastened to the rear needle block 6. This is accomplished relatively quickly and efficiently through the use of the cast, modular gauge blocks of the invention, which ensures a uniform amount of torsion angle from needle to needle within both the first and second series of needles, as reflected in FIG. 3. The torsion angle, of course, is specific to the design of each needle used, it being known to those of skill in the art that needle designs vary from needle manufacturer to needle manufacturer, and that the requirements of needle design, and geometry, vary from tufting machine manufacturer to tufting machine manufacturer. It is, however, generally preferred that a torsion angle be provided as a part of the embodiment of the needles 17 within the respective gauge blocks 7, 9, to open or widen the face of the target area 26 to ensure that the leading edge of the respective ground bias points 48, 48' engages the center line T of its respective target area 26 in an appropriate manner so that the bias point of the looper slides along the target area 26, and then slides along and against its respective pickup area 27.

Thus, the embedded modular construction of this gauging element configuration represents a significant advance over the art. Although the novel gauging element configurations of this invention may be utilized by setting individual needles within an elongate needle bar, and using an optical comparitor, or other device, to manually compare the torsion angle A of each needle with respect to one another along a first, and if provided, a second, series of parallel needles, this has a significant drawback in that it is extremely time consuming and is fraught with the possibility for error, all of which greatly slows down production rates, and increases the possibility of producing lower quality tufted articles, requiring further machine setup and calibration.

Similarly, the loopers within each pair of loopers 50, can be manually placed into a looper block and held by a set screw or other device. However, it is preferred that they be embedded as this allows for a far more uniform treatment of the spacing between the loopers in each pair of loopers at the time the looper gauge block is cast, in a controlled environment, which thus ensures maximum accuracy and control over the creation of the looper gauge module, and over the graphically designed tufted article in turn.

While preferred embodiments of the invention have been disclosed in the foregoing specification, it is understood by those skilled in the art that variations and modifications thereof can be made without departing from the spirit and scope of the invention, as set forth in the following claims. In addition, the corresponding structures, materials, acts, and equivalents of all means, or step plus function elements in the claims, below, are intended to include any structure, material, or acts for performing the functions in combination with other claimed elements, as specifically claimed herein.

What is claimed is:

1. An improved tufting machine looper assembly for use on a tufting machine, the tufting machine forming tufted piles of yarn in a backing material being passed through a tufting zone, the tufting zone being positioned with respect to the looper assembly, said looper assembly comprising:

an elongate casted modular gauge block; and a plurality of elongate loopers extending from said casted gauge block, each said looper having a proximal end fixedly embedded in said casted gauge block and a spaced distal end;

said plurality of loopers being formed into a first series of spaced loopers and a second alternating series of spaced loopers, respectively;

one each of the loopers of said first series of loopers being paired with an adjacent one of the loopers of the second series of loopers, respectively, to form spaced pairs of loopers extending at least partially along the length of said casted gauge block;

wherein the loopers within each said pair of loopers are spaced apart from one another a first distance; and wherein said pairs of loopers are spaced apart from one another a second distance different than said first distance.

2. The looper assembly of claim 1, wherein said first series of loopers is spaced from and parallel to said second series of loopers.

3. The looper assembly of claim 1, wherein said second distance between said pairs of loopers is greater than said first distance between the loopers within each said pair of loopers.

4. The looper assembly of claim 3, wherein the loopers of said plurality of loopers each have a substantially common thickness, and wherein the length of said second distance is no less than the length of said first distance plus the thickness of two of said loopers.

5. The looper assembly of claim 1, wherein said second distance between said pairs of loopers is less than said first distance between the loopers within each said pair of loopers.

6. The looper assembly of claim 5, wherein the loopers of said plurality of loopers each have a substantially common thickness, and wherein the length of said second distance is no greater than the length of said first distance less the thickness of two of said loopers.

7. The looper assembly of claim 1, the loopers of said first series of loopers each extending a first height away from said casted gauge block, the loopers of said second series of loopers each extending away from said casted gauge block a second height greater said first height.

8. The looper assembly of claim 7, wherein a pile height difference is defined by the difference between the height of the loopers of said first series of loopers and the height of the loopers of said second series of loopers, respectively for pulling tufts of yarn with the loopers of said second series of loopers to a pile height greater than the pile height of the tufts of yarn pulled by the loopers of said first series of loopers, respectively.

9. The looper assembly of claim 1, wherein each looper of said first series of loopers has a ground bias point of a first take-off hand defined at the distal end thereof, and wherein each looper of said second series of loopers has a ground bias point of a second take-off hand defined at the distal end thereof.

10. The looper assembly of claim 9, wherein said first take-off hand is a right take-off hand, and wherein said second take-off hand is a left take-off hand.

11. The looper assembly of claim 9, wherein each looper of said first series of loopers in each said pair of loopers has a right take-off hand, and wherein the looper of said second series of loopers in each said pair of loopers has an opposed left take-off hand.

12. An improved tufting machine needle and looper assembly for use on a tufting machine, the tufting machine forming tufted piles of yarn in a backing material being passed through a tufting zone, the tufting zone being positioned with respect to the needle and looper assembly, said needle and looper assembly comprising:

a first elongate modular gauge block;

a first spaced series of elongate needles of a first take-off hand extending from said first gauge block, each said needle having a proximal end fixedly embedded in said first gauge block;

a second elongate modular gauge block;

a second spaced series of elongate needles of a second take-off hand extending from said second gauge block, each said needle having a proximal end fixedly embedded in said second gauge block;

wherein said first series of needles is spaced from and parallel to said second series of needles, and wherein said first series of needles and said second series of needles combine together to form a third series of needles of a predetermined needle gauge positioned along said first and second gauge blocks, respectively;

a third elongate modular gauge block positioned with respect to both said first and said second gauge blocks;

said first, second and third gauge blocks each comprising a casted modular gauge block;

a plurality of elongate loopers extending from said third gauge block, each said looper having a proximal end fixedly embedded in said third gauge block and a spaced distal end;

said plurality of loopers being formed into a first series of spaced loopers sized and shaped to engage the needles of said first series of needles and a second alternating series of spaced loopers sized and shaped to engage the needles of said second series of needles, respectively; and one each of the loopers of said first series of loopers being paired with an adjacent one of the loopers of the second series of loopers, respectively, to form spaced pairs of loopers extending at least partially along the length of said third gauge block;

wherein a respective looper within each said pair of loopers is provided for a corresponding one of the needles within said third series of needles.

13. The needle and looper assembly of claim 12, wherein the loopers within each said pair of loopers are spaced apart from one another a first distance, and wherein said pairs of loopers are spaced apart from one another a second distance different than said first distance.

14. The needle and looper assembly of claim 13, wherein said second distance between said pairs of loopers is greater than said first distance between the loopers within each said pair of loopers.

15. The needle and looper assembly of claim 13, wherein the loopers of said plurality of loopers each have a substantially common thickness, and wherein the length of said second distance is no less than the length of said first distance plus the thickness of two of said loopers.

16. The needle and looper assembly of claim 15, wherein each respective needle of said first and said second spaced series of elongate needles comprises an elongate needle shaft formed about a longitudinal needle centerline, a target face defined on said needle shaft, said target face being sized and shaped to slidably receive a respective one of said loopers thereon, and a pick-up face defined on the needle shaft adjacent said target face, and wherein said pick-up face is rotated about the longitudinal needle centerline through an angle of approximately six degrees with respect to the respective looper for said needle.

17. The needle and looper assembly of claim 13, wherein the loopers of said plurality of loopers each have a substantially common thickness, and wherein the length of said second distance is no greater than the length of said first distance less the thickness of two of said loopers.

18. The needle and looper assembly of claim 12, wherein said first take-off hand of said first series of needles is a right take-off hand, and wherein said second take-off hand of said second series of needles is a left take-off hand.

19. The needle and looper assembly of claim 18, wherein the first take-off hand of the respective needles of said first series of needles faces toward the second take-off hand of an adjacent one of the needles of said second series of needles along said third series of needles.

20. The needle and looper assembly of claim 12, wherein each looper of said first series of loopers has a ground bias point of said first take-off hand defined at the distal end thereof, and wherein each looper of said second series of loopers has a ground bias point of said second take-off hand defined at the distal end thereof.

21. The needle and looper assembly of claim 20, wherein the respective take-off hands of the loopers within each said pair of loopers face toward one another.

22. The needle and looper assembly of claim 12, wherein the number of needles of said second series of needles is an even multiple of the number of needles in said first series of needles.

23. The needle and looper assembly of claim 12, wherein the distal ends of the respective loopers within each said pair of loopers are sized and shaped to be urged toward one another as the distal end of each respective one of said loopers becomes engaged with a respective one of the needles within said third series of needles for increasing the distance between said spaced pairs of loopers at the distal ends thereof.

24. An improved tufting machine needle and looper assembly for use on a tufting machine, the tufting machine having a first laterally shiftable needle bar and a second spaced parallel laterally shiftable needle bar, both needle bars being driven by a common reciprocating needle drive, the tufting machine forming a series of tufted yarn piles in a backing material being passed through a tufting zone below the needle bars, said needle and looper assembly comprising:

a first casted elongate modular gauge block for being mounted on the first needle bar;

a first spaced series of elongate needles of a first take-off hand projecting from said first gauge block;

a second casted elongate modular gauge block for being mounted on the second needle bar, said second gauge block being opposed from said first gauge block;

a second spaced series of elongate needles of a second take-off hand extending from said second gauge block;

wherein the needles of said first series of needles, and the needles of said second series of needles, each has a proximal end fixedly embedded in said first and in said second gauge blocks, respectively wherein said first series of needles is spaced from and parallel to said second series of needles, the needles of said first series of needles and of said second series of needles being combined together to form a third series of needles of a predetermined needle gauge extending along said first and second gauge blocks, respectively;

a third casted elongate modular gauge block positioned with respect to both said first and said second gauge blocks;

a first series of spaced and elongate loopers projecting from said gauge third gauge block, the loopers of said first series of loopers being sized and shaped to engage the needles of said first series of needles;

a second series of spaced and elongate loopers projecting from said gauge third gauge block, said second series of loopers being spaced from and parallel to said first series of loopers, and being sized and shaped to engage the needles of said second series of needles;

the respective loopers of said first series of loopers and of said second series of loopers each having a proximal end fixedly embedded in said third gauge block, and a spaced distal end; and one each of the loopers of said first series of loopers being paired with an adjacent one of the loopers of the second series of loopers, respectively, to form spaced pairs of loopers extending at least partially along the length of said third gauge block;

wherein a respective looper within each said pair of loopers is provided for a corresponding one of the needles within said third series of needles.

* * * * *

UNITED STATES PATENT AND TRADEMARK OFFICE

CERTIFICATE OF CORRECTION

PATENT NO. : 5,896,821

DATED : April 27, 1999

INVENTOR(S) : Marshall Allen Neely; Wilton Hall

It is certified that error appears in the above-identified patent and that said Letters Patent is hereby corrected as shown below:

Column 3, line 6, change "for" to -- bar --.
Column 3, line 46, change "for" to -- bar --.
Column 5, line 17, change "looped" to -- loop --.
Column 5, line 44, change "looped" to -- loop --.
Column 5, line 57, after "elongate", insert -- casted --.
Column 5, line 67 – Column 6, line 6, change "In fashion totally unknown in the art" to -- The --.
Column 6, line 27, change "ten" to -- one-tenth --.
Column 6, line 47, after "first", insert -- casted --.
Column 6, line 54, after "elongate", insert -- casted --.
Column 7, line 11, change "engage" to -- gauge --.
Column 7, line 37, change "twelve" to -- twelfth --.
Column 7, line 41, change "sixteen" to -- sixteenth --.
Column 7, line 44, change "sixteen" to -- sixteenth --.
Column 7, line 47, change "sixteen" to -- sixteenth --.
Column 7, line 52, between "machine" and "gauging" insert -- casted gauge module having a --.
Column 7, line 55, change "shift" to -- shifting --.
Column 7, line 66, change "appearing face on" to -- appearance of --.
Column 8, line 8, after "machine" insert -- casted gauge module --.
Column 8, line 9, change "shift" to -- shifting --.
Column 8, line 9, change "looped" to -- loop --.
Column 8, line 45, change "cast" to --casted --.
Column 8, line 46, change "cast" to -- casted --.
Column 8, line 47, after "modular", insert -- casted --.
Column 8, lines 58-59, delete ", although it is possible that the gauge blocks could be machined if so desired".
Column 9, line 5, change "of a one eighth inch" to --eighth --.
Column 9, line 8, change "twelve" to -- twelfth --.
Column 9, line 50, change "cast" to -- casted --.
Column 9, line 65, before "gauge", insert -- casted --.
Column 10, line 63, delete "in fashion heretofore unknown in the art".
Column 11, line 58, change "in fashion heretofore unknown in the art" to -- the present invention --.
Column 11, line 59, change "ten" to -- tenth --.
Column 11, line 65, change "ten" to -- tenth --.
Column 11, line 66, change "five" to -- fifth --.

UNITED STATES PATENT AND TRADEMARK OFFICE

CERTIFICATE OF CORRECTION

PATENT NO. : 5,896,821

DATED : April 27, 1999

INVENTOR(S) : Marshall Allen Neely; Wilton Hall

It is certified that error appears in the above-identified patent and that said Letters Patent is hereby corrected as shown below:

Column 12, line 2, change "twelve" to -- twelfth --.
Column 12, line 3, change "one-eighth" to -- eighth --.
Column 12, line 4, change "one-sixth" to -- sixth --.
Column 12, line 5, change "fourteen" to -- fourteenth".
Column 12, line 5, change "seven" to -- seventh --.
Column 12, line 6, change "sixteen" to -- sixteenth --.
Column 12, line 7, change "one-eighth" to -- eighth --.
Column 12, line 12, change "a one-eighth" to -- an eighth --.
Column 12, line 18, change "ten" to -- tenth --.
Column 12, line 55, change "twelve" to -- twelfth --.
Column 12, line 56, change "a one-eighth" to -- an eighth --.
Column 12, line 58, delete "inch".
Column 12, line 58, change "twelve" to --twelfth --.
Column 12, line 61, change "sixteen" to -- sixteenth --.
Column 12, line 66, delete "four, or".
Column 12, line 66, after "quarter", delete ",".
Column 12, line 67, change "sixteen" to -- sixteenth --.
Column 13, line 6, after "within", insert -- casted --.
Column 13, line 7, after "within", insert -- casted --.
Column 14, lines 19-20, change "is totally new to the art and solves the age old" to -- appears to solve --.
Column 15, line 14, change "ten" to -- tenth gauge --.
Column 17, line 43, change "cast" to -- casted --.
Column 17, line 61, after "embedded", insert -- casted --.
Column 21, line 23, after "respectively", insert --;--.

Signed and Sealed this

Twenty-eighth Day of November, 2000

*Attest:*

Q. TODD DICKINSON

*Attesting Officer*

*Director of Patents and Trademarks*